US010429076B2

(12) United States Patent
Cadima

(10) Patent No.: US 10,429,076 B2
(45) Date of Patent: Oct. 1, 2019

(54) GAS BURNER ASSEMBLY FOR A COOKTOP OF AN APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 414 days.

(21) Appl. No.: 15/298,347

(22) Filed: Oct. 20, 2016

(65) Prior Publication Data

US 2018/0112869 A1 Apr. 26, 2018

(51) Int. Cl.
*F24C 3/08* (2006.01)
*F23D 14/02* (2006.01)
*F24C 15/10* (2006.01)

(52) U.S. Cl.
CPC ..... *F24C 3/085* (2013.01); *F23D 14/02* (2013.01); *F24C 15/107* (2013.01)

(58) Field of Classification Search
CPC ..... F24C 15/107; F24C 3/085; F23D 14/02; F23D 14/06
USPC ..... 126/39 E
See application file for complete search history.

(56) References Cited

U.S. PATENT DOCUMENTS 4,264,298 A * 4/1981 Simeoni ..... F23D 14/06 126/376.1
5,800,159 A 9/1998 Maughan et al.
6,135,764 A * 10/2000 Kwiatek ..... F23D 14/06 126/39 E
2010/0005976 A1* 1/2010 Inzaghi ..... F23D 14/06 99/444
2011/0143295 A1* 6/2011 Fowler ..... F23D 14/06 431/285
2015/0107577 A1* 4/2015 Jeong ..... F24C 3/08 126/39 E
2015/0219340 A1* 8/2015 Cadima ..... F23D 14/06 126/39 E
2015/0345799 A1 12/2015 Cadima et al.
2016/0178209 A1* 6/2016 Park ..... F23D 14/06 126/39 E
2016/0178211 A1* 6/2016 Park ..... F23D 14/06 126/39 E
(Continued)

*Primary Examiner* — Avinash A Savani
*Assistant Examiner* — Aaron H Heyamoto
(74) *Attorney, Agent, or Firm* — Dority & Manning, P.A.

(57) ABSTRACT

A gas burner assembly for a cooktop of an appliance includes a burner base defining a circumferential direction, an axial direction, and a radial direction. The burner base includes an inner sidewall and an outer sidewall. The inner sidewall defines a simmer flame port and a plurality of primary flame ports. The primary flame ports of the plurality of primary flame ports are spaced apart from one another along the circumferential direction on the inner sidewall. The outer wall is spaced apart from the inner sidewall along the radial direction such that a fuel chamber is positioned therebetween. In addition, the burner base defines a stability chamber extending from the simmer flame port of the inner sidewall outwardly along the radial direction. The burner base defines, at least in part, a stability chamber extending from the simmer flame port of the inner sidewall outwardly along the radial direction.

18 Claims, 9 Drawing Sheets

(56) References Cited

U.S. PATENT DOCUMENTS

| | | | | |
|---|---|---|---|---|
| 2016/0178212 | A1* | 6/2016 | Park | F23D 14/06 126/39 E |
| 2017/0067632 | A1* | 3/2017 | Angulo | F23L 9/00 |
| 2017/0138605 | A1* | 5/2017 | Cadima | F24C 15/107 |
| 2017/0205075 | A1* | 7/2017 | Cadima | F24C 3/082 |
| 2017/0205076 | A1* | 7/2017 | Cadima | F24C 3/12 |
| 2018/0320903 | A1* | 11/2018 | Cadima | F24C 3/027 |

* cited by examiner

GAS BURNER ASSEMBLY FOR A COOKTOP OF AN APPLIANCE

FIELD OF THE INVENTION

The present subject matter relates generally to a gas burner assembly for a cooktop of an appliance.

BACKGROUND OF THE INVENTION

Gas burners are commonly used on the cooktops of household gas cooking appliances including e.g., range ovens and cooktops built into cabinetry. A significant factor of gas burners is their ability to withstand airflow disturbances in the surroundings, such as room drafts, rapid movement of cabinet doors, and most commonly oven door manipulation. For appliances which include both an oven and cooktop, manipulation of the oven door can be particularly troublesome because rapid opening and closing of the oven door can produce respective under-pressure and over-pressure conditions within the oven cavity. These pressure changes may cause rapid expansion and/or contractions in the structures. As a result, a large amount of air passes through or around the gas burners with e.g., rapid opening or closing of the oven door(s). Similarly for built-in cooktops, pressure changes due to rapid manipulation of surrounding cabinets may result in large amounts of airflow through or around the gas burners.

Such surges of air around the gas burners, due to pressure disturbances in the surroundings, are detrimental to the flame stability of the burners and may cause extinction of the flames. This flame stability problem is particularly evident in sealed gas burner arrangements, which lack an opening in the cooktop surface around the base of the burner so as to prevent spills from entering the area beneath the cooktop.

The inherent cause of this flame instability is the low pressure drop of the fuel/air mixture passing through the flame ports of a typical burner used on the cooktop of an appliance. Although there is ample pressure available in the fuel, the pressure energy is used to accelerate the fuel to the high injection velocity required for primary air entrainment. Relatively little of this pressure is available at the flame ports. A low pressure drop across the flame ports allows pressure disturbances propagating through the ambient to easily pass through the flame ports, momentarily drawing the flame towards the burner base and leading to thermal quenching and extinction.

A solution to the above-described problem is the use of a stability chamber as described e.g., in U.S. Pat. No. 5,800,159, commonly owned by the assignee of the present disclosure. The burner is able to maintain a simmer flame at both low and high settings so that the simmer flame can relight the flame at primary flame ports when needed. However, the use of stability chambers has been limited to gas burners having a centrally located burner throat that delivers fuel to the flame ports in a radially outward fashion. Thus, inwardly fired burners, such as inverted gas burners, cannot withstand pressure disturbances as well as traditional gas burners, and are more prone to flame extinction due to pressure disturbances.

Accordingly, an inwardly fired burner with features for maintaining a simmer flame would be welcomed within the technology.

BRIEF DESCRIPTION OF THE INVENTION

The present disclosure provides a gas burner assembly for a cooktop of an appliance. The gas burner assembly includes a burner base having a simmer flame port and a plurality of primary flame ports. The burner base defines a stability chamber extending outwardly from the simmer flame port. The stability chamber can assist with limiting flame extinction due to pressure disturbances. Additional aspects and advantages of the invention will be set forth in part in the following description, or may be apparent from the description, or may be learned through practice of the invention.

In a first exemplary embodiment, a gas burner assembly for a cooktop of an appliance includes a burner base defining a circumferential direction, an axial direction, and a radial direction. The burner base includes an inner sidewall and an outer sidewall. The inner sidewall defines a simmer flame port and a plurality of primary flame ports. The primary flame ports of the plurality of primary flame ports are spaced apart from one another along the circumferential direction on the inner sidewall. The outer wall is spaced apart from the inner sidewall along the radial direction such that a fuel chamber is positioned therebetween. In addition, the burner base defines, at least in part, a stability chamber extending from the simmer flame port of the inner sidewall outwardly along the radial direction.

In a second exemplary embodiment, a gas burner assembly for a cooktop of an appliance includes a burner base defining a circumferential direction, an axial direction, and a radial direction. The burner base includes an inner sidewall, an outer sidewall, and a baffle. The inner sidewall defines a simmer flame port and a plurality of primary flame ports. The primary flame ports of the plurality of primary flame ports are spaced apart from one another along the circumferential direction on the inner sidewall. The outer wall is spaced apart from the inner sidewall along the radial direction such that a fuel chamber is positioned therebetween. The baffle is positioned between the inner and outer sidewalls along the radial direction. In addition, the baffle defines a plurality of recesses. The recesses of the plurality of recesses are spaced apart from one another along the circumferential direction on the baffle. The burner base defines, at least in part, a stability chamber extending from the simmer flame port of the inner sidewall outwardly along the radial direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
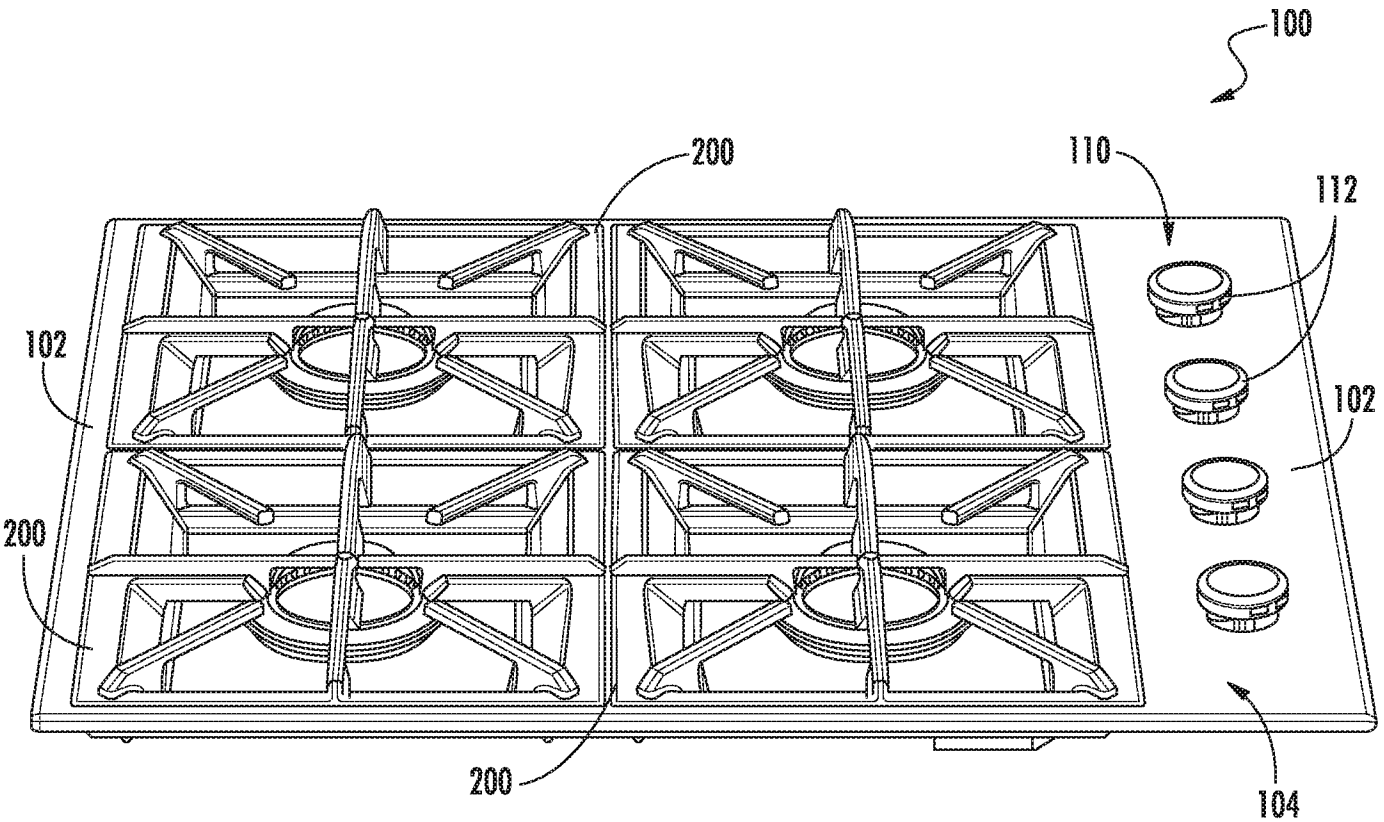
FIG. 1 provides a top, perspective view of a cooktop appliance according to an exemplary embodiment of the present subject matter.

Repeat use of reference characters in the present specification and drawings is intended to represent the same or analogous features or elements of the present invention

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. The cooktop appliance 100 includes a panel 102, e.g., a top panel. By way of example, the panel 102 may be constructed of enameled steel, stainless steel, glass, ceramics, and combinations thereof.

For the cooktop appliance 100, a utensil holding food and/or cooking liquids (e.g., oil, water, etc.) may be placed onto gas burner assemblies 200 at a location of any of the gas burner assemblies 200. The gas burner assemblies 200 can be configured in various sizes so as to provide e.g., for the receipt of cooking utensils (i.e., pots, pans, etc.) of various sizes and configurations and to provide different heat inputs for such cooking utensils. The gas burner assemblies 200 are supported on a top surface 104 of the panel 102, as discussed in greater detail below. The gas burner assemblies 200 provide thermal energy to cooking utensils above panel 102.

A user interface panel 110 is located within convenient reach of a user of the cooktop appliance 100. For this exemplary embodiment, the user interface panel 110 includes knobs 112 that are each associated with one of gas burner assemblies 200. The knobs 112 allow the user to activate each burner assembly and determine the amount of heat input each gas burner assembly 200 provides to a cooking utensil located thereon. The user interface panel 110 may also be provided with one or more graphical display devices that deliver certain information to the user such as e.g., whether a particular burner assembly is activated and/or the level at which the burner assembly is set.

Although shown with the knobs 112, it should be understood that the knobs 112 and the configuration of the cooktop appliance 100 shown in FIG. 1 is provided by way of example only. More specifically, the user interface panel 110 may include various input components, such as one or more of a variety of touch-type controls, electrical, mechanical or electro-mechanical input devices including rotary dials, push buttons, and touch pads. User interface panel 110 may include other display components, such as a digital or analog display device designed to provide operational feedback to a user.

The cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
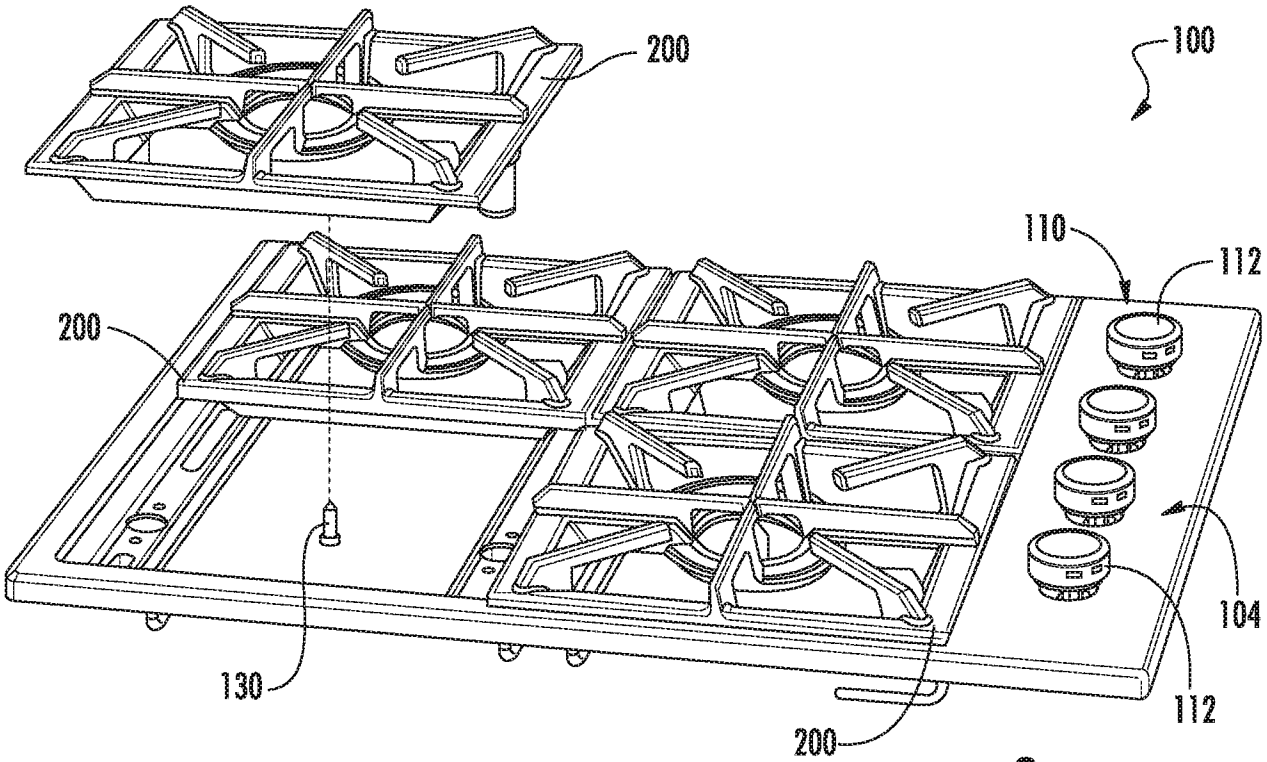
FIG. 2 provides another top, perspective view of the exemplary cooktop appliance of FIG. 1 with a gas burner assembly of the exemplary cooktop appliance shown removed from a panel of the exemplary cooktop appliance.

FIG. 2 provides another top, perspective view of the cooktop appliance 100 with a gas burner assembly 200 of the cooktop appliance 100 shown removed from the panel 102 of the cooktop appliance 100. As may be seen in FIG. 2, the gas burner assembly 200 is removable from the panel 102 of the cooktop appliance 100. In certain exemplary embodiments, no mechanical fastening connects the gas burner assembly 200 to the panel 102. Thus, the gas burner assembly 200 may not be fastened to the panel 102, and a user may simply lift the gas burner assembly 200 upwardly to remove the gas burner assembly 200 from the panel 102, as shown in FIG. 2. In such a manner, a top surface 104 of the panel 102 below the gas burner assembly 200 may be easily accessible and cleanable.

Figure 3:
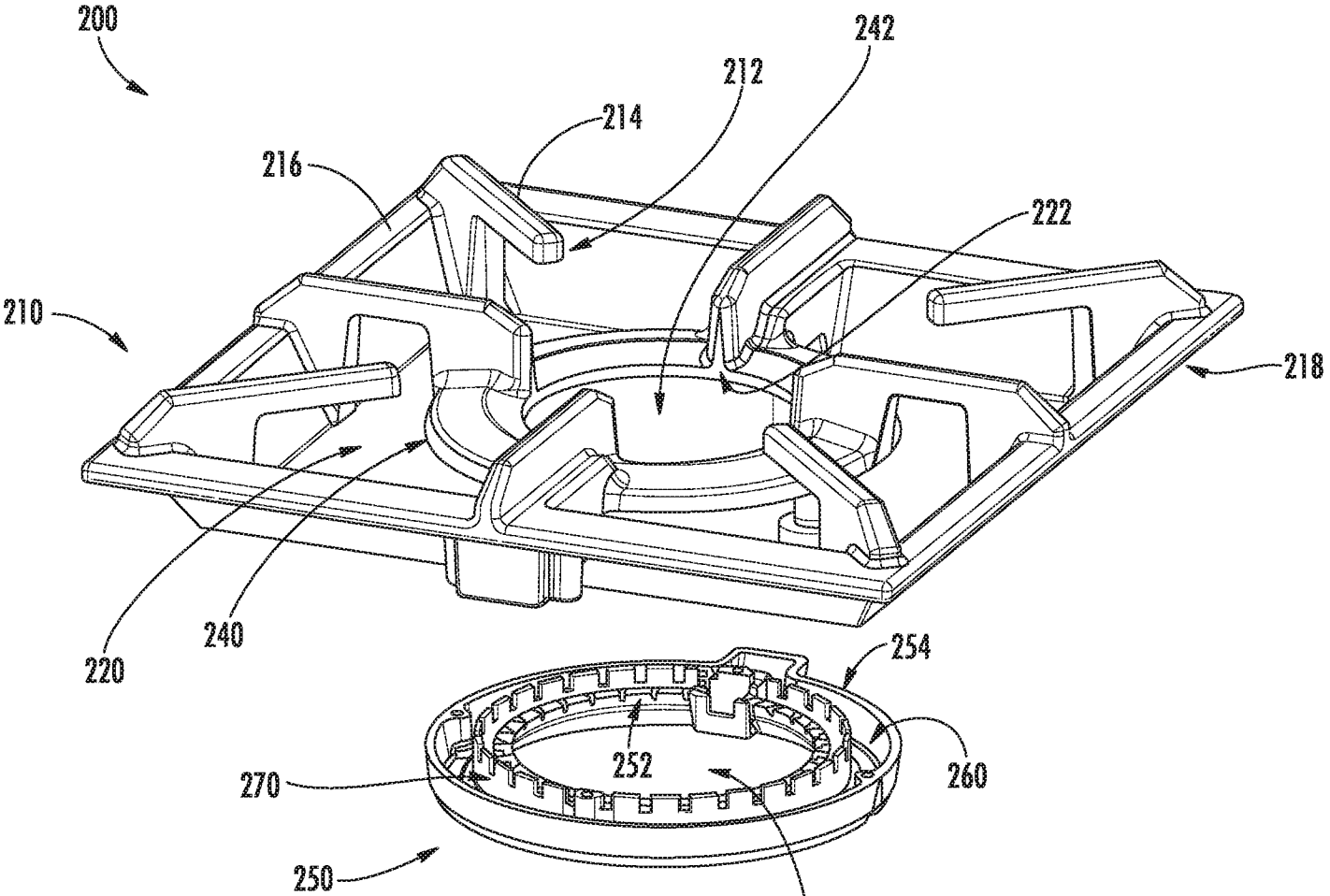
FIG. 3 provides a bottom, perspective view of the exemplary gas burner assembly depicted FIG. 2.

FIG. 3 provides an exploded view of the gas burner assembly 200. As shown, the gas burner assembly 200 defines a vertical direction V. The gas burner assembly 200 includes a grate 210 configurable for supporting a cooking utensil, such as a pot, pan, etc. For example, the grate 210 includes a plurality of tines or elongated members 212, e.g., formed of cast metal, such as cast iron. The cooking utensil may be placed on the elongated members 212 of the grate 210 such that the cooking utensil rests on an upper surface 214 of the elongated members 212. The elongated members 212 of the grate 210 may include an outer frame 216 that extends around or defines a perimeter of the grate 210 and/or the gas burner assembly 200. Thus, the outer frame 216 may be positioned at an outer portion 218 of the grate 210. The grate 210 may rest on the panel 102 at the outer frame 216 of the grate 210. Thus, a bottom surface of the outer frame 216 may rest on the top surface 104 of the panel 102. As shown, the outer frame 216 of the grate 210 may be square or rectangular in certain exemplary embodiments. Within the outer frame 216, the elongated members 212 may define an inner passage 220 that extends vertically through the grate 210. Thus, fluid, such as air, may flow through the grate 210 via the inner passage 220.

The gas burner assembly 200 may also include a burner cap 240 and a burner base 250. The burner cap 240 may define an opening 242, which may be a hollow circular region within the center of the burner cap 240. The burner cap 240 may be mounted to the grate 210. In particular, the burner cap 240 may be integrally formed with the grate 210, e.g., such that the grate 210 and the burner cap 240 are formed of or with a common piece of metal. For example, the grate 210 and the burner cap 240 may be cast as a single continuous piece of metal, such as cast iron.

Figure 4:
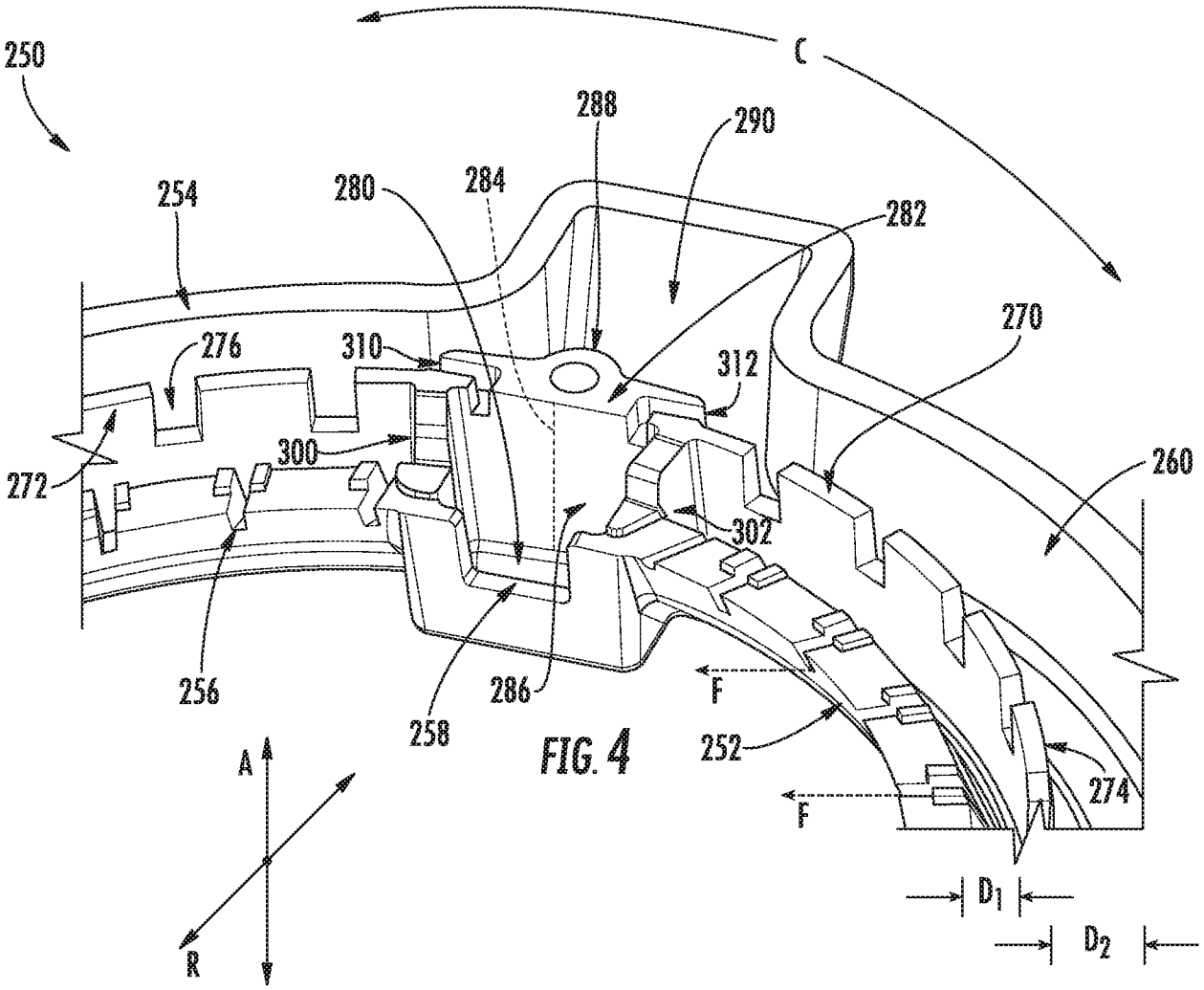
FIG. 4 provides a top, perspective view of a portion of an exemplary burner base of the gas burner assembly of FIG. 3.

Referring now to FIGS. 3 and 4, the burner base 250 defines a circumferential direction C, an axial direction A, and a radial direction R. The burner base 250 may be mounted to the burner cap 240, e.g., with fasteners (not shown). Thus, the burner cap 240 and the burner base 250 may be separate pieces of metal, such as cast metal, that are mounted to each other to form a gas burner. However, according to alternative embodiments, the gas burner may be formed from a single piece of material or from more than two pieces of material.

The burner base 250 includes an inner sidewall 252 and an outer sidewall 254. In certain exemplary embodiments, the inner sidewall 252 and/or the outer sidewall 254 may be arcuate and extend along the circumferential direction C. As shown, the inner sidewall 252 defines a plurality of primary flame ports 256 spaced apart from one another along the circumferential direction C on the inner sidewall 252. The inner sidewall 252 also defines a simmer flame port 258. More specifically, the simmer flame port 258 may be disposed between two primary flame ports 256 along the circumferential direction C on the inner sidewall 252. The outer sidewall 254 is spaced apart from the inner sidewall 252 along the radial direction R such that a fuel chamber 260 is positioned therebetween.

It should be understood that, in some exemplary embodiments, a bottom portion of the burner base 250 may be spaced apart from the burner cap 240 along the axial direction A. Thus, in some embodiments, the fuel chamber 260 may be positioned between the inner and outer sidewalls 252, 254 along the radial direction R, and between the burner cap 240 and the bottom portion of the burner base 250 along the axial direction A.

The burner base 250 defines a combustion chamber 259, which may be a hollow circular region within the center of the burner base 250. The inner sidewall 252 may surround the combustion chamber 259 along the circumferential direction C. As such, air may flow through the combustion chamber 259 along the axial direction A, and the air may mix with a gaseous fuel/air mixture exiting the plurality of primary flame ports 256 and the simmer flame port 258 as indicated by arrows F in FIG. 4. The gas burner assembly 200 may also include an igniter 130 (FIG. 2) positioned within the combustion chamber 259 to ignite the gaseous fuel/air mixture F flowing into the combustion chamber 259 via the simmer flame port 258 and/or each of the plurality of primary flame ports 256.

The burner base 250 may also include a baffle 270 (FIG. 4) positioned between the inner sidewall 252 and the outer sidewall 254 along the radial direction R. The baffle 270 may extend between an interior surface 272 and an exterior surface 274 along the radial direction R. The interior surface 272 of the baffle 270 may face the inner sidewall 252 along the radial direction R, and the exterior surface 274 of the baffle 270 may face the outer sidewall 254 along the radial direction R.

As shown in FIG. 4, the interior surface 272 of the baffle 270 may be spaced apart from the inner sidewall 252 by a first distance $D_1$ along the radial direction R. In addition, the exterior surface 274 of the baffle 270 may be spaced apart from the outer sidewall 254 by a second distance $D_2$ along the radial direction R. In some embodiments, the first distance $D_1$ may be equal to the second distance $D_2$. Thus, in some embodiments, the baffle 270 may be positioned equidistant from the inner and outer sidewalls 252, 254 along the radial direction R. However, in alternative embodiments, the first distance $D_1$ may be different than the second distance $D_2$. For example, in some embodiments, the first distance $D_1$ may be less than the second distance $D_2$. Thus, in some embodiments, the baffle 270 may be positioned closer to the inner sidewall 252 than the outer sidewall 254.

The baffle 270 may define a plurality of recesses 276, and the plurality of recesses 276 may be spaced apart from one another along the circumferential direction C on the baffle 270. Accordingly, the fuel chamber 260 may extend from the inner sidewall 252 to the outer sidewall 254 through the plurality of recesses 276 formed on the baffle 270. It should be appreciated that the baffle 270 may promote a uniform pressure within the burner base 250 proximate the primary flame ports 256 in order to produce uniform flame lengths around the inner sidewall 252.

Figure 5:
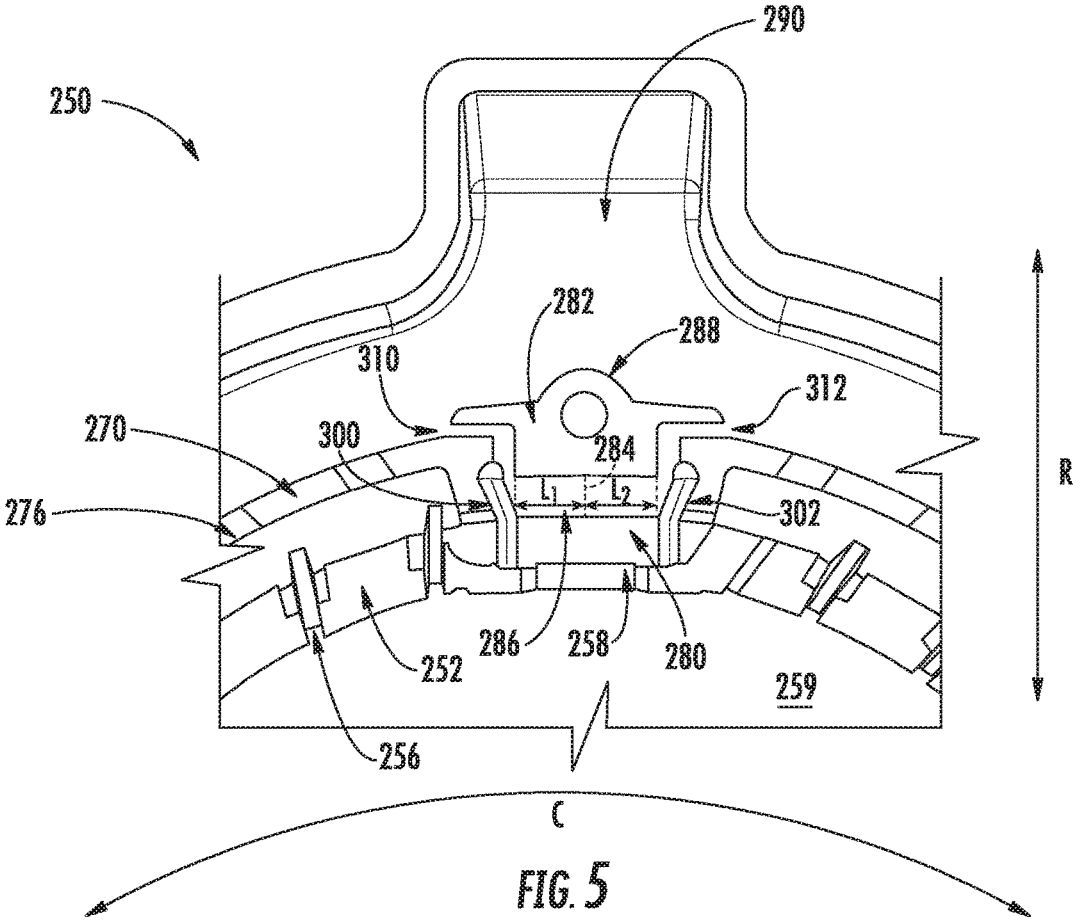
FIG. 5 provides a top-down view of the portion shown in FIG. 4.

Referring now to FIGS. 4 and 5, the burner base 250 defines, at least in part, a stability chamber 280 extending outwardly from the simmer flame port 258 along the radial direction R, e.g., such that the stability chamber 280 extends from the inner sidewall 252 into the burner base 250 along the radial direction R. As shown, the stability chamber 280 may be defined, at least in part, by an end wall 282 positioned within the burner base 250. More specifically, the end wall 282 may be positioned between the inner sidewall 252 and the outer sidewall 254 along the radial direction R. The end wall 282 may define a centerline axis 284 extending therethrough along the axial direction A. For example, the centerline axis 284 may extend through a center or centroid of the end wall 282, e.g., in a plane that is perpendicular to the radial direction R.

As shown, the end wall 282 extends between an interior surface 286 and an exterior surface 288 along the radial direction R. More specifically, the interior surface 286 of the end wall 282 may face the stability chamber 280 along the radial direction R, and the exterior surface 288 of the end wall 282 may face the fuel chamber 260 along the radial direction R. In some embodiments, the interior surface 286 of the end wall 282 may be aligned with the interior surface 272 of the baffle 270 along the circumferential direction C. In addition, the exterior surface 288 of the end wall 282 may be spaced apart from the exterior surface 274 of the baffle 270 along the radial direction R.

The stability chamber 280 may be further defined, at least in part, by a pair of opposing walls 300, 302 positioned within the burner base 250 and spaced apart from one another along the circumferential direction C. Each opposing wall 300, 302 may extend outwardly from the simmer flame port 258, e.g., along the radial direction R. For example, each opposing wall 300, 302 may extend outwardly from the simmer flame port 258 to the end wall 282 along the radial direction R. The stability chamber 280 may be further defined between the burner cap 240 and a bottom portion of the burner base 250 along the axial direction A. Accordingly, in some exemplary embodiments, the stability chamber 280 may be positioned between the simmer flame port 258 and the end wall 282 along the radial direction R, between the pair of opposing walls 300, 302 along the circumferential direction C, and between the burner cap 240 and the bottom portion of the burner base 250 along the axial direction A. In addition, the stability chamber 280 may also be positioned adjacent to an inlet 290 of the fuel chamber 260. As will be discussed below in more detail, gaseous fuel may enter the fuel chamber 260 at the inlet 290.

The end wall 282 may, at least in part, define a first inlet port 310 and a second inlet port 312. The first and second inlet ports 310, 312 may extend between the fuel chamber 260 and the stability chamber 280. Thus, the fuel chamber 260 may be in fluid communication with the stability chamber 280 via the first and second inlet ports 310, 312.

In an alternative embodiment, opposing wall 300 may, at least in part, define the first inlet port 310, and opposing wall 302 may, at least in part, define the second inlet port 312. More specifically, opposing wall 300 and the end wall 282 may each define a portion of the first inlet port 310, whereas opposing wall 302 and the end wall 282 may each define a portion of the second inlet port 312.

As shown, the first and second inlet ports 310, 312 may be spaced apart from one another along circumferential direction C. For example, the first and second inlet ports 310, 312 may each be spaced apart from the centerline axis 284 of the end wall 282 along circumferential direction C. More specifically, the first inlet port 310 may be spaced apart from the centerline axis 284 by a first distance $L_1$ along the circumferential direction C, and the second inlet port 312 may be spaced apart from the centerline axis 284 by a second distance $L_2$. In some embodiments, the first distance $L_1$ may be equal to the second distance $L_2$. Thus, in some embodiments, the first and second inlet ports 310, 312 may be positioned equidistant from the centerline axis 284 of the end wall 282. However, in alternative embodiments, the first distance $L_1$ may be less than the second distance $L_2$. Thus, in some embodiments, the first inlet port 310 may be positioned closer to the centerline axis 284 than the second inlet port 312 along the circumferential direction C.

Figure 6:
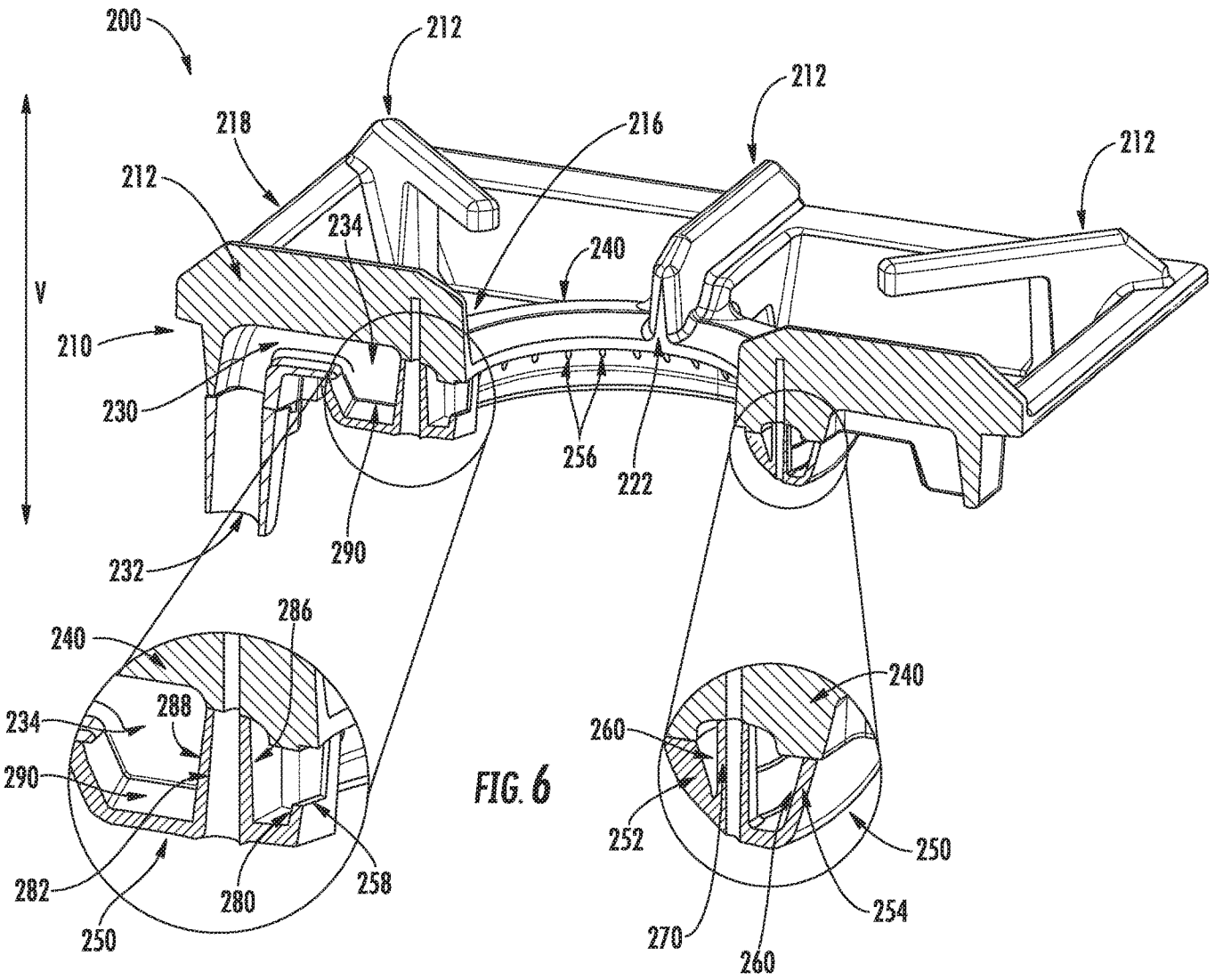
FIG. 6 provides a cross-section, perspective view of a portion of the exemplary gas burner assembly depicted in FIG. 3.

Referring now to FIG. 6, the grate 210 includes features for supplying fuel to the burner base 250, e.g., to the fuel chamber 260. The grate 210 defines an internal fuel passage 230, e.g., configured for directing fuel through the grate 210 to the burner base 250. It should be appreciated that the grate 210 may be constructed of or with any suitable material. For example, the grate 210 may be constructed of or with a single piece of cast metal. In particular, the grate 210 may be formed of cast iron with the internal fuel passage 230 formed within the grate using disposable cores during the casting process.

The internal fuel passage 230 extends between an inlet 232 and an outlet 234. The inlet 232 is positioned at or adjacent the outer portion 218 of the grate 210. Conversely, the outlet 234 is positioned at or adjacent the central portion 222 of the grate 210. Thus, the internal fuel passage 230 may extend between the outer portion 218 and the central portion 222 of the grate 210 within one of the elongated members 212 of the grate 210. In addition, at least a portion of the internal fuel passage 230 may be positioned above (i.e. higher along a vertical direction V that is parallel to the axial direction A) the simmer flame port 258 and/or each primary flame port 256. Alternatively, or in addition to, the internal fuel passage 230 may be positioned adjacent the stability chamber 280.

The outlet 234 is contiguous with, or adjacent to, the fuel chamber 260. More specifically, the outlet 234 of the internal fuel passage 230 is positioned above the inlet 290 of the fuel chamber 260 along the vertical direction V. Thus, fuel from the internal fuel passage 230 may flow into the fuel chamber 260 via the outlet 234. Fuel may then exit the fuel chamber 260 at the simmer flame port 258 and each of the plurality of primary flame ports 256. As will be discussed below in more detail, fuel may also exit the fuel chamber 260 at the first and second inlet ports 310, 312 and subsequently enter the stability chamber 280.

Figure 7:
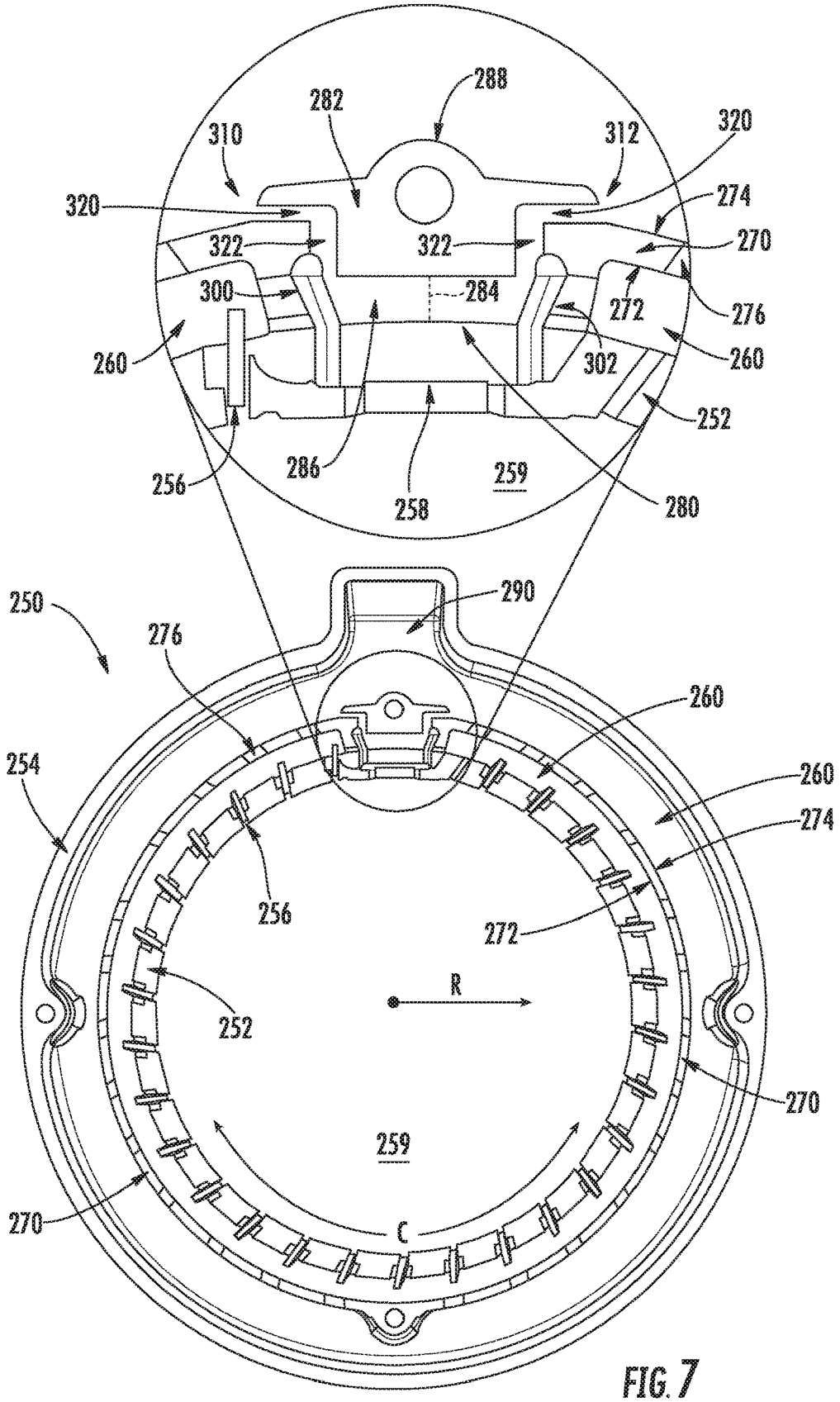
FIG. 7 provides a top-down view of the burner base depicted in FIG. 3.
Figure 8:
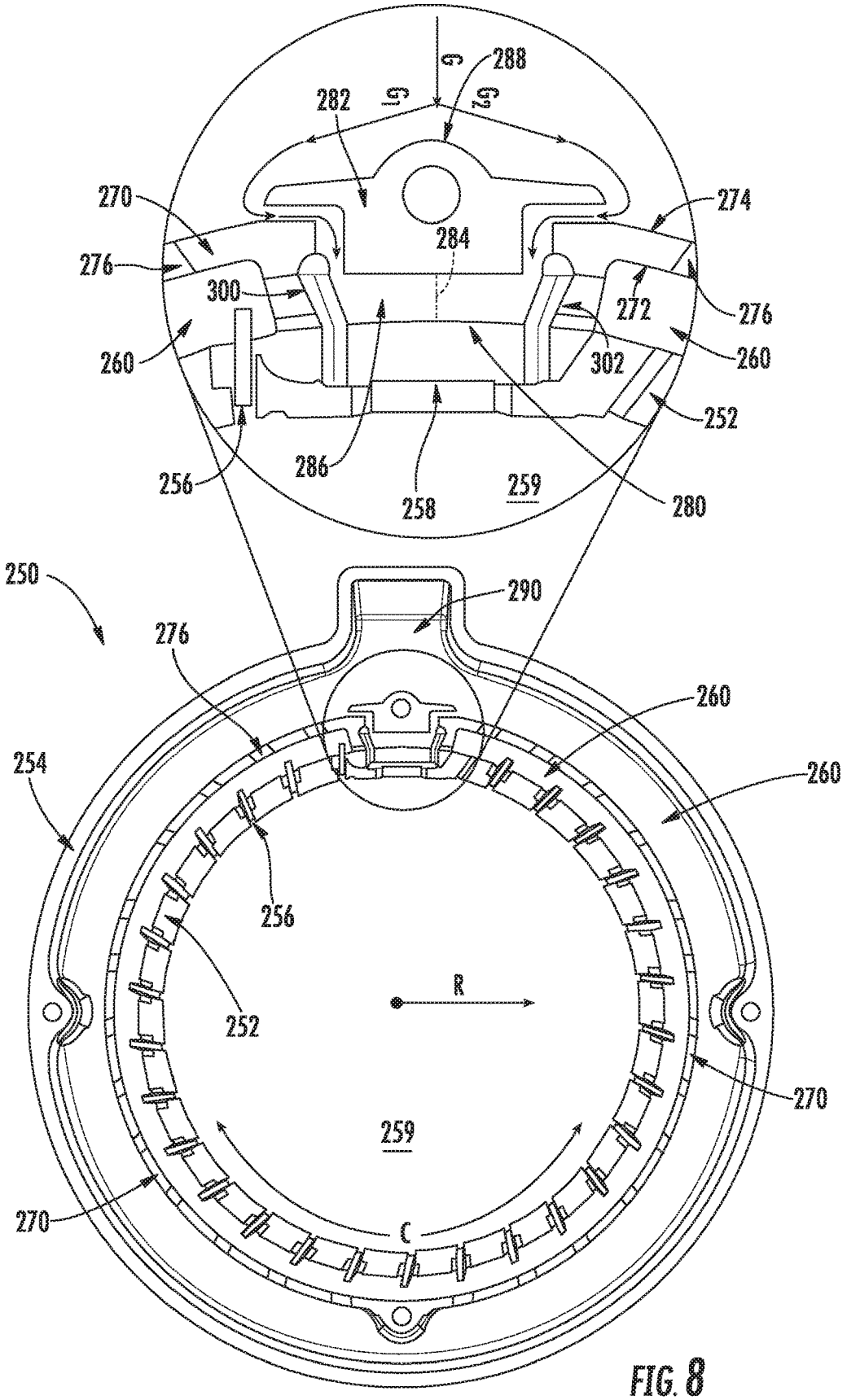
FIG. 8 provides another top-down view of the burner base depicted in FIG. 3.
Figure 9:
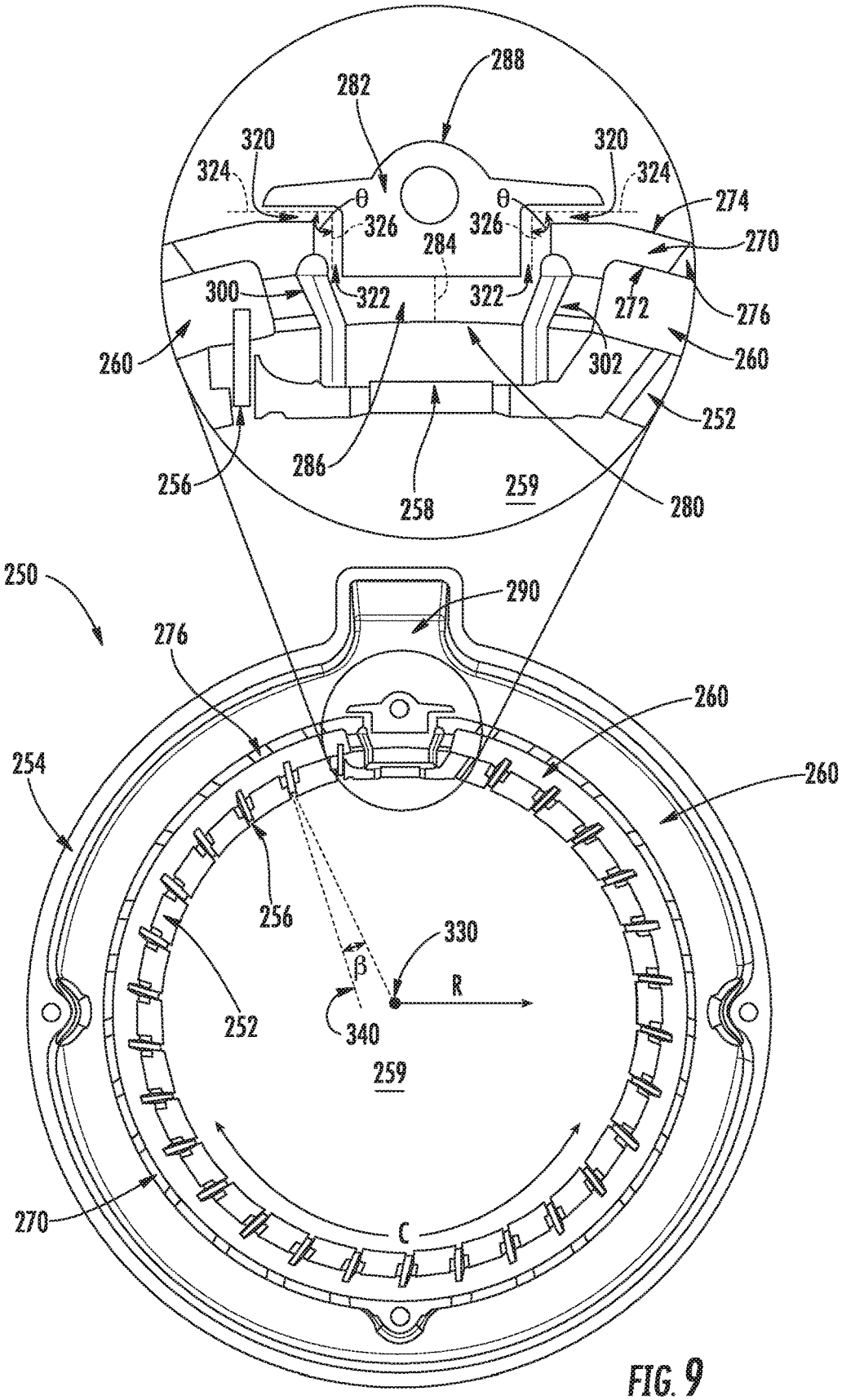
FIG. 9 provides yet another top-down view of the burner base depicted in FIG. 3.

Referring now to FIGS. 7-9, the first and second inlet ports 310, 312 may each include a first portion 320 and a second portion 322. The first portion 320 may extend from the fuel chamber 260 and into the end wall 282. For example, the first portion 320 may extend from the fuel chamber 260 into the end wall 282 e.g., along the circumferential direction C. More specifically, the first portion 320 may be positioned between the baffle 270 and the outer sidewall 254 along the radial direction R. The second portion 322 may extend from the first portion 320 to the stability chamber 280 along the radial direction R.

As shown in FIG. 8, a flow of gas G entering the fuel chamber 260 via the inlet 290 may contact or impact the end wall 282. In particular, the flow of gas G may split at the centerline axis 284. For example, the flow of gas G may split into a first flow of gas G1 and a second flow of gas G2. The first flow of gas G1 and the second flow of gas G2 may flow in opposite directions along the circumferential direction C. In particular, the first flow of gas G1 may flow into the stability chamber 280 via the first inlet port 310, and the second flow of gas G2 may flow into the stability chamber 280 via the second inlet port 312. More specifically, the first flow of gas $G_1$ may flow through the first and second portions 320, 322 of the first inlet port 310 and may subsequently flow into the stability chamber 280. Likewise, the second flow of gas $G_2$ may flow through the first and second portions 320, 322 of the second inlet port 312 and may subsequently flow into the stability chamber 280. As will be discussed below in more detail, the first and second portions 320, 322 of the first inlet port 310 may be angled relative to one another in order to reduce the rate of the first flow of gas $G_1$ prior to entering the stability chamber 280. Likewise, the first and second portions 320, 322 of the second inlet port 312 may be angled relative to one another in order to reduce the rate of the second flow of gas $G_2$ prior to entering the stability chamber 280.

As shown in FIG. 9, the first portion 320 of both the first and second inlet ports 310, 312 defines a central axis 324 in a plane that is perpendicular to the axial direction A. Likewise, the second portion 322 of both the first and second inlet ports 310, 312 defines a central axis 326 in a plane that is perpendicular to the axial direction A. More specifically, the central axis 324 of the first portion 320 extends e.g., along the circumferential direction C between the exterior surface 288 of the end wall 284 and the exterior surface 274 of the baffle 270. In addition, the central axis 326 of the second portion 322 intersects the central axis 324 of first portion 320. As such, the first portion 320 and the second portion 322 may define an angle θ therebetween. For example, in one embodiment, the first and second portions 320, 322 may be substantially perpendicular to one another. In another embodiment, the angle θ between the first and second portions 320, 322 may be less than ninety (90) degrees. In yet another embodiment, the angle θ between the first and second portions 320, 322 may be greater than ninety (90) degrees but less than one hundred and eighty (180) degrees.

Still referring to FIG. 9, the combustion chamber 259 may define a central point 330 that is equidistant from each of the plurality of primary flame ports 256 along the radial direction R. More specifically, the plurality of primary flame ports 256 may each define a central axis 340 extending along the radial direction R. In addition, the central axis 340 may be angled relative to the central point 330 of the combustion chamber 259. As such, the plurality of flame ports 256 and the central point 330 of the combustion chamber 259 may define an angle θ therebetween. Thus, the gaseous fuel F (FIG. 4) exiting the plurality of primary flame ports 256 may swirl about the central point 330 of the combustion chamber 259 upon entering the combustion chamber 259. In addition, the gaseous fuel and air mix within the combustion chamber 259 and the flames may be angled relative to the central point 330 within the combustion chamber 259.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A gas burner assembly for a cooktop of an appliance, the gas burner assembly comprising:

a burner base defining a circumferential direction, an axial direction, and a radial direction, the burner base comprising:

an inner sidewall defining a plurality of primary flame ports spaced apart from one another along the circumferential direction, the inner sidewall further defining a simmer flame port;

an outer sidewall spaced apart from the inner sidewall along the radial direction such that a fuel chamber is positioned therebetween;

an end wall defining a first inlet port and a second inlet port;

a first wall extending between the inner sidewall and the end wall along the radial direction; and a second wall spaced apart from the first wall along the circumferential direction, the second wall extending between the inner sidewall and the end wall along the radial direction, wherein the end wall, the first wall, and the second wall define, at least in part, a stability chamber that extends radially outward from the simmer flame port, and wherein the first inlet port and the second inlet port each extend between the fuel chamber and the stability chamber.

2. The gas burner assembly of claim 1, wherein a portion of the first inlet port is defined by the end wall and the first wall, and wherein a portion of the second inlet port is defined by the end wall and the second wall.

3. The gas burner assembly of claim 1, wherein the first inlet port and the second inlet port are spaced apart from one another along the circumferential direction, wherein the end wall defines a centerline axis extending therethrough along the axial direction, and wherein the first inlet port and the second inlet port are each spaced equidistant from the centerline axis along the circumferential direction.

4. The gas burner assembly of claim 3, wherein the first inlet port and the second inlet port each include a first portion and a second portion, wherein the first portion extends from the fuel chamber and into the end wall, and wherein the second portion extends from the first portion to the stability chamber along the radial direction.

5. The gas burner assembly of claim 4, wherein the first portion and second portion are substantially perpendicular to one another.

6. The gas burner assembly of claim 1, wherein the stability chamber is positioned adjacent an inlet of the fuel chamber.

7. The gas burner assembly of claim 6, wherein the burner assembly further comprises:

a grate having a plurality of elongated members for supporting a cooking utensil, at least one of the plurality of elongated members defining an internal fuel passage that is contiguous with the inlet of the fuel chamber.

8. The gas burner assembly of claim 7, wherein at least a portion of the internal fuel passage is spaced apart from the plurality of primary flame ports along the axial direction.

9. A gas burner assembly for a cooktop of an appliance, the gas burner assembly comprising:

a burner base defining a circumferential direction, an axial direction, and a radial direction, the burner base comprising:

an inner sidewall defining a plurality of primary flame ports spaced apart from one another along the circumferential direction, the inner sidewall further defining a simmer flame port;

an outer sidewall spaced apart from the inner sidewall along the radial direction such that a fuel chamber is positioned therebetween;

a baffle positioned between the inner sidewall and the outer sidewall along the radial direction, the baffle defining a plurality of recesses spaced apart from one another along the circumferential direction;

an end wall defining a first inlet port and a second inlet port;

a first wall extending between the inner sidewall and the end wall along the radial direction; and a second wall spaced apart from the first wall along the circumferential direction, the second wall extending between the inner sidewall and the end wall along the radial direction, wherein the end wall, the first wall, and the second wall define, at least in part, a stability chamber that extends radially outward from the simmer flame port, and wherein the first inlet port and the second inlet port each extend between the fuel chamber and the stability chamber.

10. The gas burner assembly of claim 9, wherein the first inlet port and the second inlet port are spaced apart from one another along the circumferential direction, wherein the end wall defines a centerline axis extending therethrough along the axial direction, and wherein the first inlet port and the second inlet port are each spaced equidistant from the centerline axis along the circumferential direction.

11. The gas burner assembly of claim 10, wherein the first inlet port and the second inlet port each include a first portion and a second portion, wherein the first portion extends from the fuel chamber and into the end wall, and wherein the second portion extends from the first portion to the stability chamber along the radial direction.

12. The gas burner assembly of claim 11, wherein the first portion and the second portion are substantially perpendicular to one another.

13. The gas burner assembly of claim 9, wherein the stability chamber is positioned adjacent an inlet of the fuel chamber.

14. The gas burner assembly of claim 9, wherein the burner assembly further comprises:

a grate having a plurality of elongated members for supporting a cooking utensil, at least one of the plurality of elongated members defining an internal fuel passage that is contiguous with the inlet of the fuel chamber.

15. The gas burner assembly of claim 14, wherein at least a portion of the internal fuel passage is spaced apart from the plurality of primary flame ports along the axial direction.

16. The gas burner assembly of claim 9, wherein the baffle is spaced apart from the inner sidewall along the radial direction by a first distance, and wherein the baffle is spaced apart from the outer sidewall along the radial direction by a second distance.

17. The gas burner assembly of claim 16, wherein the second distance is greater than the first distance.

18. The gas burner assembly of claim 16, wherein the first distance is greater than the second distance.

* * * * *